US005581343A

United States Patent [19]

Chowdry et al.

[11] Patent Number: 5,581,343

[45] Date of Patent: Dec. 3, 1996

[54] IMAGE-FORMING METHOD AND APPARATUS ADAPTED TO USE BOTH UNCOATED AND THERMOPLASTIC-COATED RECEIVER MATERIALS

[75] Inventors: Arun Chowdry, Pittsford; Feraydoon S. Jamzadeh, Fairport, both of N.Y.

[73] Assignee: Eastman Kodak Company, Rochester, N.Y.

[21] Appl. No.: 320,018

[22] Filed: Oct. 7, 1994

[51] Int. Cl.[6] ..... G03G 21/00

[52] U.S. Cl. ..... 355/311; 355/274; 355/279

[58] Field of Search ..... 355/208, 271, 355/274, 276, 279, 308, 309, 311

[56] References Cited

U.S. PATENT DOCUMENTS

| | | | |
|---|---|---|---|
| 4,006,983 | 2/1977 | Pressman et al. | 355/219 |
| 4,181,423 | 1/1980 | Pressman et al. | 355/327 |
| 4,648,709 | 3/1987 | Bushaw | 355/77 |
| 4,825,256 | 4/1989 | Nakai et al. | 355/311 X |
| 4,885,613 | 12/1989 | Kudoh | 355/310 |
| 4,890,139 | 12/1989 | Takebe | 355/268 |
| 4,927,727 | 5/1990 | Rimai et al. | 430/99 |
| 5,049,937 | 9/1991 | Takeda | 355/245 |
| 5,126,797 | 7/1992 | Forest et al. | 355/278 |
| 5,130,757 | 7/1992 | Ito | 355/311 |
| 5,136,341 | 8/1992 | Takemura et al. | 355/311 |
| 5,187,526 | 2/1993 | Zaretsky | 355/273 |
| 5,398,101 | 3/1995 | Takada et al. | 355/208 |

*Primary Examiner*—William J. Royer
*Attorney, Agent, or Firm*—Leonard W. Treash, Jr.

[57] ABSTRACT

An electrostatic printing apparatus includes the capability of effecting both thermal assisted transfer and electrostatic transfer and also either area modulation exposure, density modulation exposure or a combination of both area and density modulation exposure. The apparatus is usable with area modulation exposure while imaging on thermoplastic coated receiving material is accomplished preferably with thermal assisted transfer and density modulation exposure.

13 Claims, 6 Drawing Sheets

IMAGE-FORMING METHOD AND APPARATUS ADAPTED TO USE BOTH UNCOATED AND THERMOPLASTIC-COATED RECEIVER MATERIALS

BACKGROUND OF THE INVENTION

1. Technical Field of the Invention

The present invention is directed to high-quality electrophotography, using small toner particles, and using at least two different types of exposures or transfer methods, depending on the surface properties of the receiver used.

2. Description of the Prior Art

Toner particle size plays a key role in determining image quality in electrophotography, smaller particles generally yielding better image quality. However, as the particles get smaller, the physics of the forces holding the particles to the photoconductor changes drastically, needing new methods to effectively transfer them from the photoconductor to the receiver.

One such new method is thermally assisted transfer, disclosed in U.S. Pat. No. 4,927,727, issued to Rimai et al. U.S. Pat. Nos. 4,994,827; 5,151,717; and 5,047,791, all issued to Jamzadeh et at, disclose color printers that, by using small toner particles and thermally assisted transfer, produce pictorial quality images on thermoplastic-coated receivers. It is apparent from these disclosures that a thermoplastic-coated receiver is necessary for thermally assisted transfer. It should be noted that with the use of thermoplastic-coated receivers, the extra cost of coating a thermoplastic layer on plain paper could be a deterrent in some applications. Another disadvantage of using thermoplastic-coated paper is the nonrecyclability. A further problem with thermoplastic-coated paper is the extra difficulty of handling them because they are easily charged up electrostatically. Also, there are certain applications where the surface of the receiver must be non-smooth and somewhat rough, e.g., greeting cards.

U.S. Pat. Nos. 4,181,423 and 4,006,983, issued to Pressman et at, disclose an electrostatic color printer that is capable of printing on coated and uncoated paper. However, this printer is not able to handle the electrostatic transfer of small toners because of complications, such as those explained in U.S. Pat. No. 4,927,727. Furthermore, the exposure step in the disclosed patents has not been modified according to the type of receiver used. It can be seen that changing the exposure method depending on the surface smoothness of the receiver will improve the image quality considerably.

U.S. Pat. No. 5,282,001, issued to Watson, teaches of "selectively variable operating parameters in accordance with differing characteristics of sheets to be used". Specifically, it teaches of changing "the time starting to form a buckle in each of the sheets just prior to transfer of a developed image" according to the type of the sheets used. The single property of the sheet that is identified as the distinguishing factor is the weight of the receiver, i.e., normal 80 g. $m^{-2}$ versus heavy card stock. This patent does not refer to the surface smoothness of the receiver as a distinguishing factor for process modifications. Consequently, it does not teach of the difficulties of transferring small toner particles to paper having different surface characteristics. Furthermore, it does not teach the use of different techniques of electronic exposure to accommodate different transfer requirements. The disclosure teaches of "setting operating parameter values from a non-volatile memory", i.e., selecting different but fixed parameters but it does not teach of using different methods.

SUMMARY OF THE INVENTION

The present invention provides for the selected use of a variety of receivers with either thermoplastic-coated receiver or uncoated receiver in the same printer. It is also an object of this invention to produce very high quality images on the mentioned variety of receiver stocks. It is the further object of this invention to disclose a pictorial quality color electrophotographic printer that will apply different exposures and different transfer methods according to the type of receiver selected, each appropriate for a specific application. Another object of this invention is to use thermoplastic coated paper as well as plain paper in a single printer. The present invention incorporates novel exposure circuitry and discloses unique paper handling mechanisms that will allow for the realization of all the listed object.

The present invention provides an electrostatographic printing apparatus adapted to use first and second major groups of receiving materials, the first group being thermoplastic-coated and the second group being uncoated. The apparatus comprising means for selecting between the thermoplastic-coated and uncoated receiver material with means for using electrostatic transfer in response to the selection of an uncoated receiver material and means for using one of the thermal assisted transfer and electrostatic transfer in response to the selection of a coated receiver material. Further including means for selecting from the following of exposure techniques: area modulation exposure, density modulation exposure or a combination of both area and density modulation.

BRIEF DESCRIPTION OF THE DRAWINGS

This and other objects and features of the present invention will become clear from the following description taken in conjunction with preferred embodiments thereof with reference to the accompanying drawings in which:

FIGS. 1, 1A and 1B are is a selection charts of subsystem operations and the corresponding characteristics and benefits associated therewith;

DESCRIPTION OF THE PREFERRED EMBODIMENT

Figure 1A:
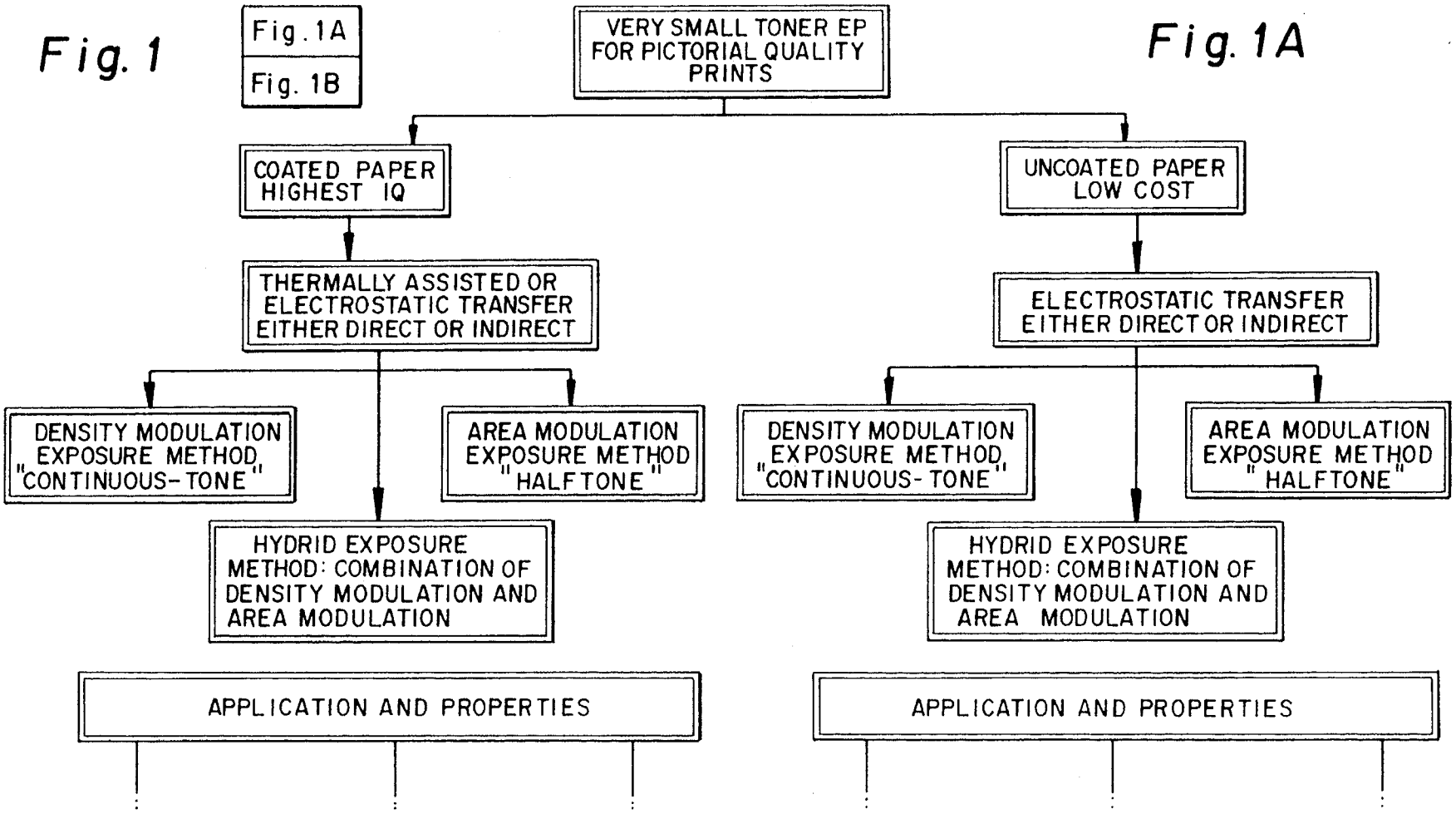
Figure 1B:
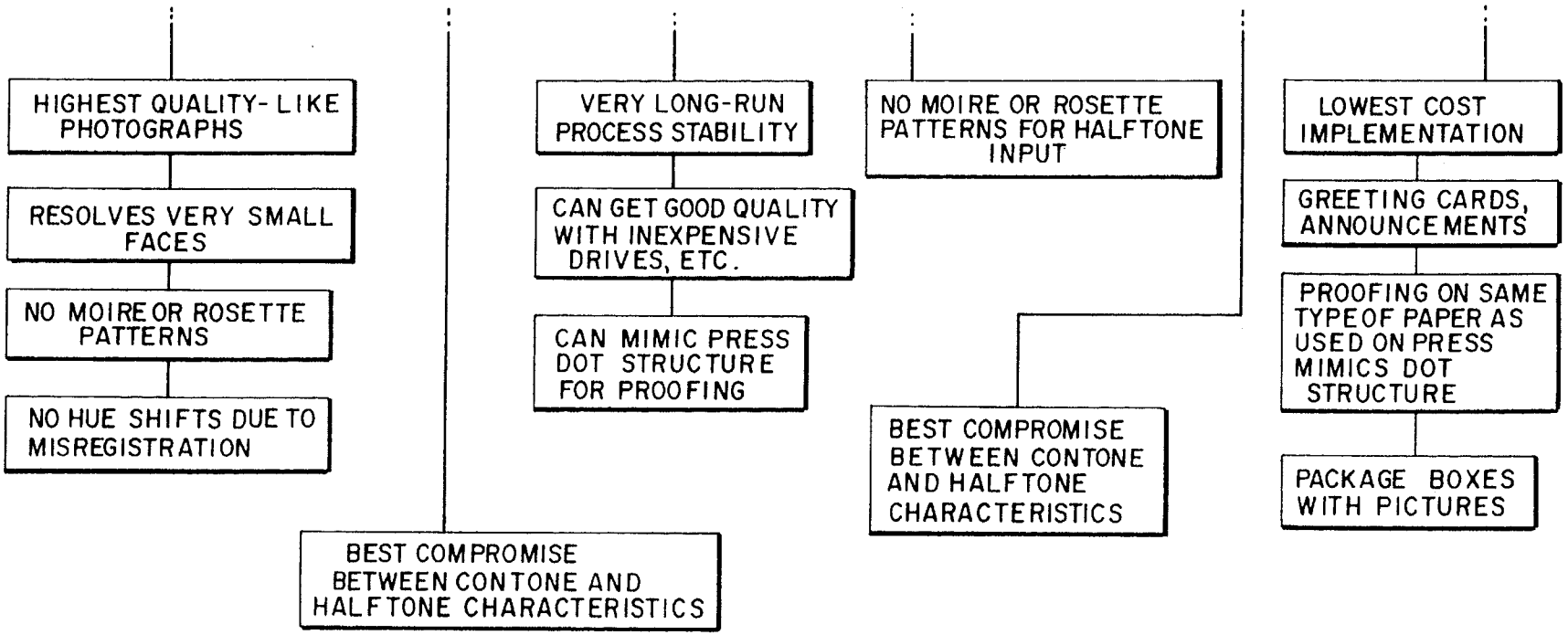

FIG. 1 shows an exposure selection chart for use with small toner particles to produce pictorial quality prints. As can be seen, the second row indicates the types of receiver sheets that can be selected. Normally, a thermoplastic-coated paper is desirable for applications where very high image quality is desirable, such as photographs or proofs of color prints. Uncoated surface receivers tend to be used when cost is a major consideration. Uncoated surface receivers are also used for special effects, e.g., greeting cards and invitations. Heavy stock paper is generally the receiver of choice for greeting cards. In the third row, the type of transfer process is illustrated that should be used based on the type of receiver selected. For example, for thermoplastic-coated receivers, two options exist: thermally assisted or electrostatic transfer. If the thermoplastic-coated paper is chosen, then the thermally assisted transfer process generally yields the highest transfer efficiencies, resulting in the highest image quality. This mechanism will be explained further in conjunction with FIG. 2. However, because the thermally assisted transfer process is generally unsuitable for plain paper, electrostatic transfer may also be used with thermoplastic-coated paper for a general purpose machine. If uncoated paper is chosen, then the electrostatic transfer is the preferred method. This approach will be explained with a description of FIGS. 3 and 4. The fourth row indicates the type of electronic exposure to be used. Area modulation and density modulation exposures are the two options that will be explained in detail in conjunction with FIG. 5. The bottom portion of FIG. 1 summarizes the reasons and/or benefits of each combination of three basic elements of electrophotographic printers: (a) paper type, (b) method of transfer process, and (c) exposure method.

The different combination of subsystems in each column of FIG. 1 provides distinct benefits or trade-offs for different applications. For each kind of paper, three exposure methods are shown. Density modulation, or continuous-tone for thermoplastic-coated paper usually renders the highest image quality. Other advantages of density modulation are the ability to resolve small faces, no moiré or rosette patterns for halftone input, and no hue shifts due to misregistration. However, for certain types of uncoated papers, the image quality for density modulation is degraded, as toner areas of different stack heights cannot uniformly transfer to rough paper, causing blotchiness and mottle in the images. Area modulation, or "true", or "hard-dot" halftone, is the exposure method commonly used in lithography, and results in a very stable process over long runs, as the density gradations are a result of area modulation, which is generally easier to maintain than density modulation, where many shades of gray levels per dot need to be maintained. Area modulation renders a similar advantage to electrophotography, particularly when rough paper is used. Another advantage of the halftone exposure method is the ability to mimic the halftone exposure method commonly used in printing presses, for a proofing application. For certain kinds of uncoated paper, such as greeting cards, halftoning may be the only viable choice due to the extreme roughness of the paper surface. Halftoning, in many cases, allows the lowest cost implementation of a pictorial imaging system. However, because the halftoning process introduces a dot structure to the image, it often is perceived as degrading pictorial image quality, particularly when the dot structure is coarse, such as in newspapers or desktop laser printers. Furthermore, if halftone originals are used, and the absence of moiré or rosette patterns is important, then a density modulation method may be preferred, even for use with uncoated paper. For each type of paper, a "hybrid" form of exposure is also indicated, where gray levels are obtained partly through density, and partly through area modulation. In some cases, this method would constitute the best compromise for the exposure method.

Figure 2:
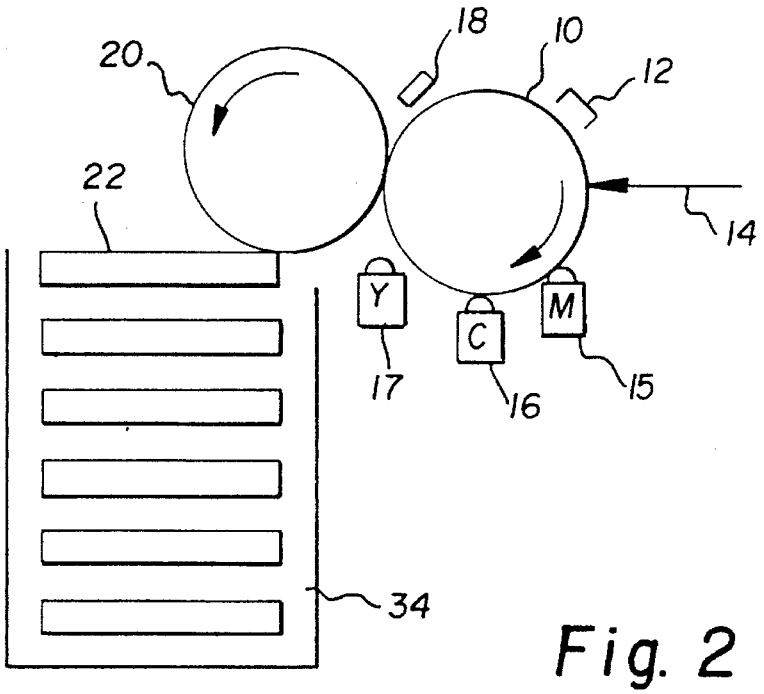
FIG. 2 is a schematic side elevational view showing the paper path in a printer using direct transfer.

FIG. 2 illustrates the overall construction of an electrophotographic printer. The imaging process begins with charging the photoconductor drum 10 by the charger unit 12. The charged surface is rotated and passed by the laser beam 14, which exposes the latent image on the drum 10. The latent image is developed by one of the color development stations 15, 16 and 17. At the same time, the receiver sheet 22 is wrapped around the transfer drum 20. The machine's logic and control (not shown) will engage the two drums (i.e., 20 and 10) at the right moment such that the developed images will be transferred to the correct location on receiver 22. In order to complete a color image, this process is repeated two or three more times, each time an image is developed using different color toner particles.

Photographic quality prints can be produced with this process if very small toner particles are used. The drawback with small particles is the difficulty in transferring them onto plain paper. One solution to this problem is explained in U.S. Pat. No. 4,968,578, where the surface of the receiver sheets are coated with a thermoplastic layer. The receiver is heated before it comes in contact with the toned images on the photoconductor drum 10. The heat will soften the receiver surface and make it sticky so that when it comes in contact with the toned image, all the toner particles will adhere to the surface of receiver 22. This results in very efficient transfer of small toner particles with little residual left on the photoconductor drum 10. Note that in this type of transfer, the paper stays on the transfer drum for 3 or 4 revolutions and enters the nip between the transfer drum and the PC drum 3 or 4 times, respectively. It should also be noted that no electrostatic field is needed in transferring toner particles from PC drum 10 to the receiver 22 on the transfer drum 20.

The key to the explained thermal transfer process of small toner particles is the thermoplastic coating layer on the receiver sheets 22. Referring to FIG. 2, receiver sheets are put in a tray 34 and fed into machine one at a time.

The arrangement in FIG. 2 can also be used in a "direct electrostatic" transfer process. Here, the transfer drum is not heated, but an electric field of the opposite polarity to the polarity of toner charge is applied to the transfer drum 20. This field attracts the toner from the photoconductor to the paper that is mounted on the transfer drum 20.

Figure 3:
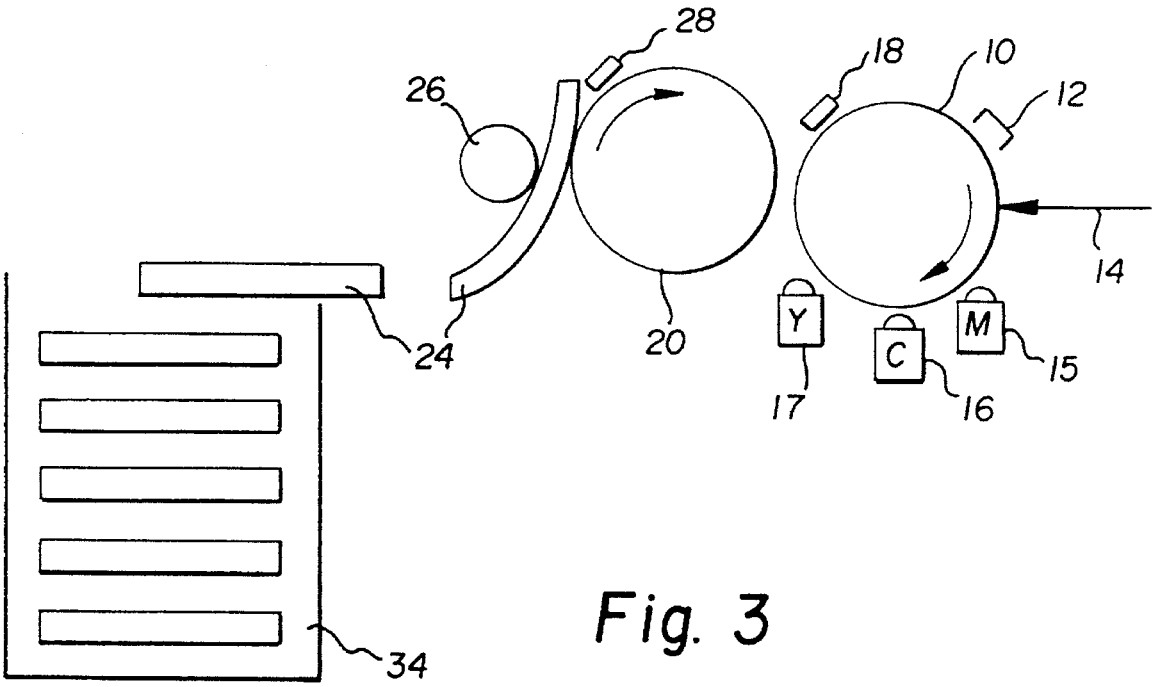
FIGS. 3 and 8 are schematic side elevational views showing the paper path in a printer using intermediate transfer.
Figure 4:
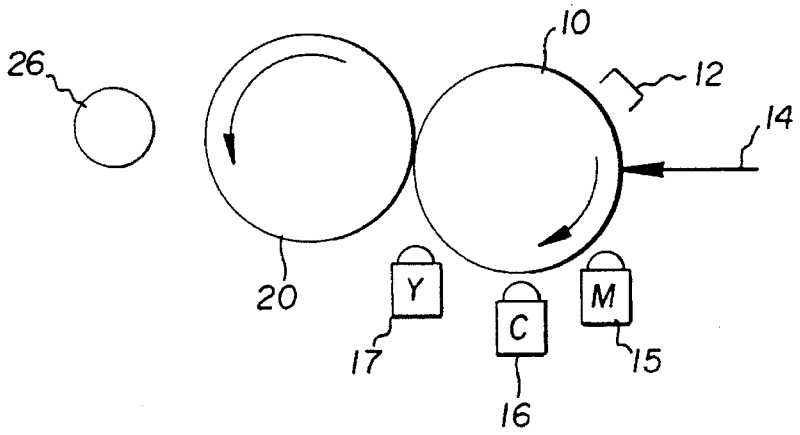
FIG. 4 is a schematic side elevational view showing a printer that transfers a toned image from the photoconductive drum to a transfer drum for intermediate transfer.
Figure 5:
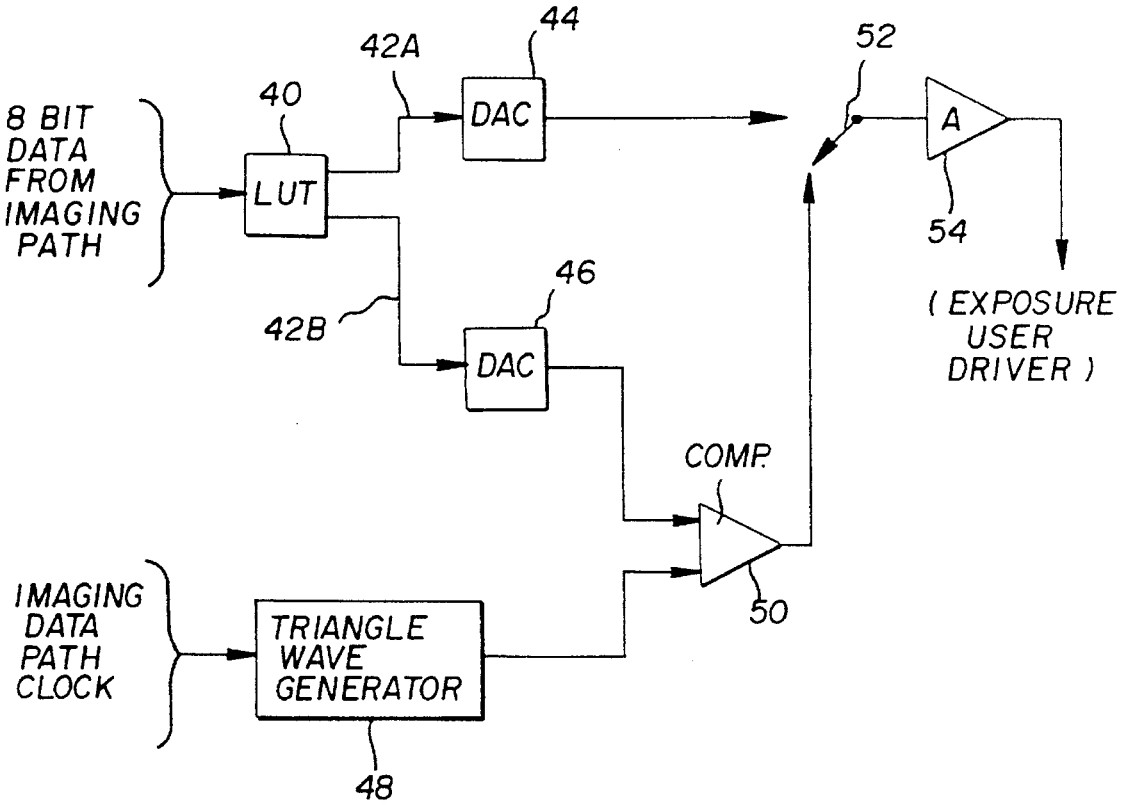
FIG. 5 is a schematic diagram showing a circuit for use with either amplitude modulation or pulse width modulation of a driver for a laser exposure device.

FIGS. 3 and 4 explain how the "indirect electrostatic" transfer works in this apparatus. The transfer drum 20 will engage with the photoconductor drum 3 or 4 times as explained before for the "direct" transfer. Except there is no paper or receiver sheet in the nip. This first transfer step of the "indirect electrostatic" transfer process is shown specifically in FIG. 4. The toner particles of the 3 or 4 latent image separations are transferred to the drum 20, one on top of the other. Assuming toner particles are charged positively, the field applied to the transfer drum 20 will be negative to attract the toner particles. It should be noted that the drum 20 rotates in a counter-clockwise direction during this initial transfer. Then the drum 20 is withdrawn from engagement with the photoconductor drum 10, stopped, and rotated in a clockwise direction. As shown explicitly in FIG. 3, the uncoated paper receiver sheet 24 is fed in the nip formed by the engagement of drum 20 and the "paper backup" roller 26. The transfer drum 20 is required to rotate only once to transfer all of the color separations onto the uncoated paper receiver sheet 24. A positive field is applied to transfer drum 20 during this second transfer to repel and push the toner particles away from transfer drum 20 and onto the uncoated paper receiver sheet 24. When the trailing edge of uncoated paper receiver sheet 24 leaves the nip of transfer drum 20 and paper backup roller 26, the transfer drum 20 is stopped, rotated in a counter-clockwise direction, and then engaged with the photoconductor drum 10 for the next imaging cycle. In the present invention, "electrostatic transfer" is either a "direct" electrostatic transfer or an "indirect" electrostatic transfer.

Figure 6:
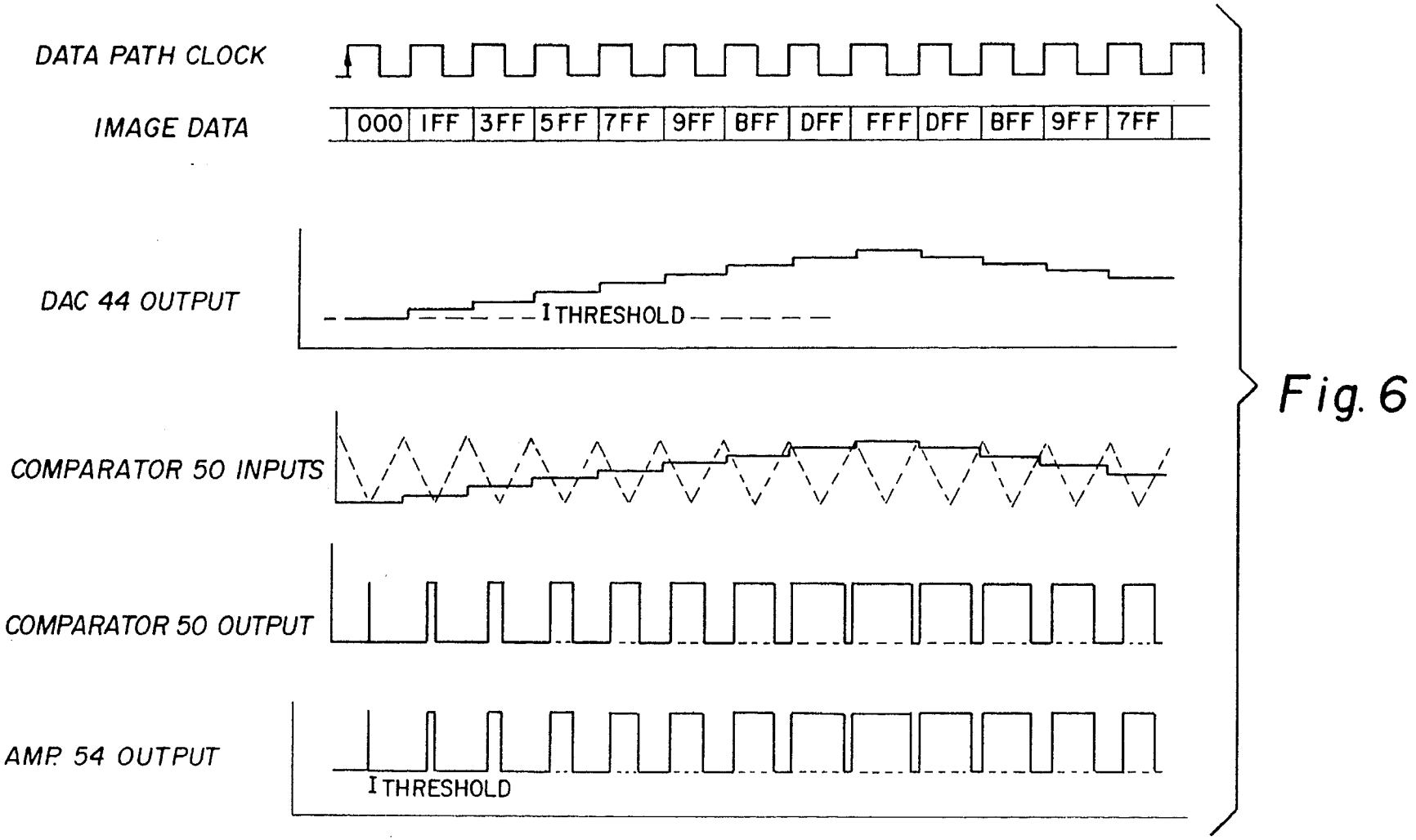
FIG. 6 illustrates signal diagrams of signals found at various points in the circuit shown in FIG. 5.

Turning our attention next to the exposure techniques needed to accommodate different types of receiver surfaces. As indicated before, density modulation, or continuous tone exposure, provides the highest possible image quality, but area modulation, or halftone exposure, would be required under certain conditions. The circuitry shown in FIG. 5 allows for both exposure methods to be practiced by a single exposure subsystem. The image data is fed into look-up table (LUT) 40 one byte at a time representing each pixel. In parallel to this, the data path clock (shown as first waveform in FIG. 6) is sent to triangle wave generator 48. The look-up table 40 converts the 8-bit data into 12-bit data. This is needed for better control of the exposure device, e.g., laser. The 12 bits allows for use of 4096 exposure levels. The 8-bit input data means all the image information is represented by 256 gray levels. Therefore, the look-up table 40 translates the image data into 256 levels out of 4096 possibilities. The two identical 12-bit signals that are generated by look-up table 40 are shown to appear on lines 42A and 42B. The numerical value of these signals is shown as the second waveform in FIG. 6. Signal on line 42A is the input of the digital-to-analog converter (DAC) 44. Analog Device, Inc. manufactures an ultrahigh speed 12-bit DAC under "HDS-1250" label that is suitable for this application. This DAC as an element of the continuous tone exposure portion creams an analog signal whose amplitude is proportional to instantaneous value of the digital pixel value. The time domain representation of this signal is shown as the third waveform in FIG. 6. The high bandwidth solid state switch 52 is controlled by the printer logic and control unit (not shown) and it allows either the amplitude modulation or the pulse width modulation signal to be fed into the exposure device driver amplifier 54. Siliconix SD210 or SD5000 are two possible switches that can be used as switch 52. DAC 46 is in the pulse width portion of the circuit, but it operates similarly to DAC 44 and its output is shown with solid lines in the fourth waveform of FIG. 6. The triangle wave generator 48 creates a triangle wave shape substantially synchronized to the data path clock. Its output is shown with dashed lines in the fourth waveform of FIG. 6. An example of this type of wave generator is HP3314A. The comparator 50 will generate a full intensity positive signal whenever its upper input is more positive than its lower input signal. This output signal is shown as the fifth waveform in FIG. 6. The Analog Devices Inc. ultra fast TTL comparators AD9696 or AD9698 are practical examples for comparator 50. One of the tasks for driver amplifier 54 is to increase its signal level of the input from switch 52 so it can drive the exposure subsystem. If a laser system is used for exposure, the driver amplifier 54 will also shift the output signal such that the laser will always be at the lasing threshold. This is shown by the last chart in FIG. 6.

Figure 7:
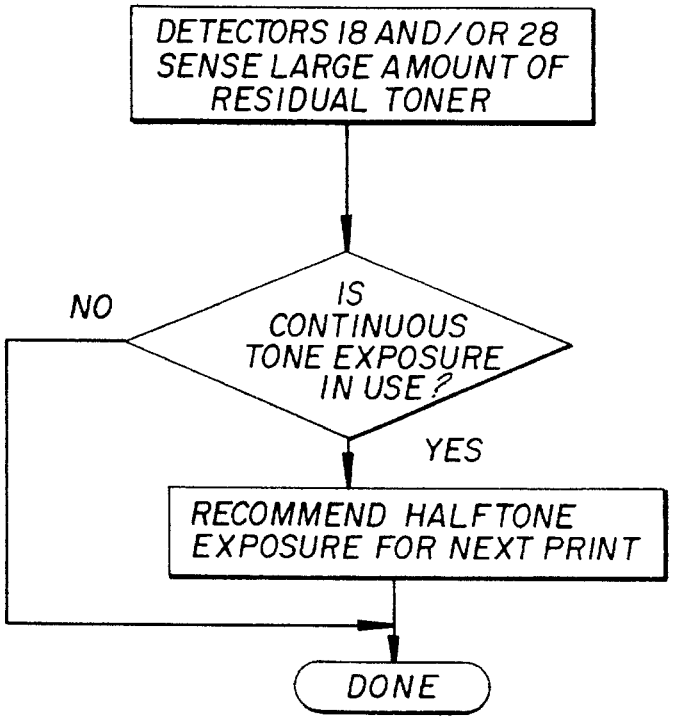
FIG. 7 illustrates a flow chart for the improved image exposure method and apparatus.
Figure 8:
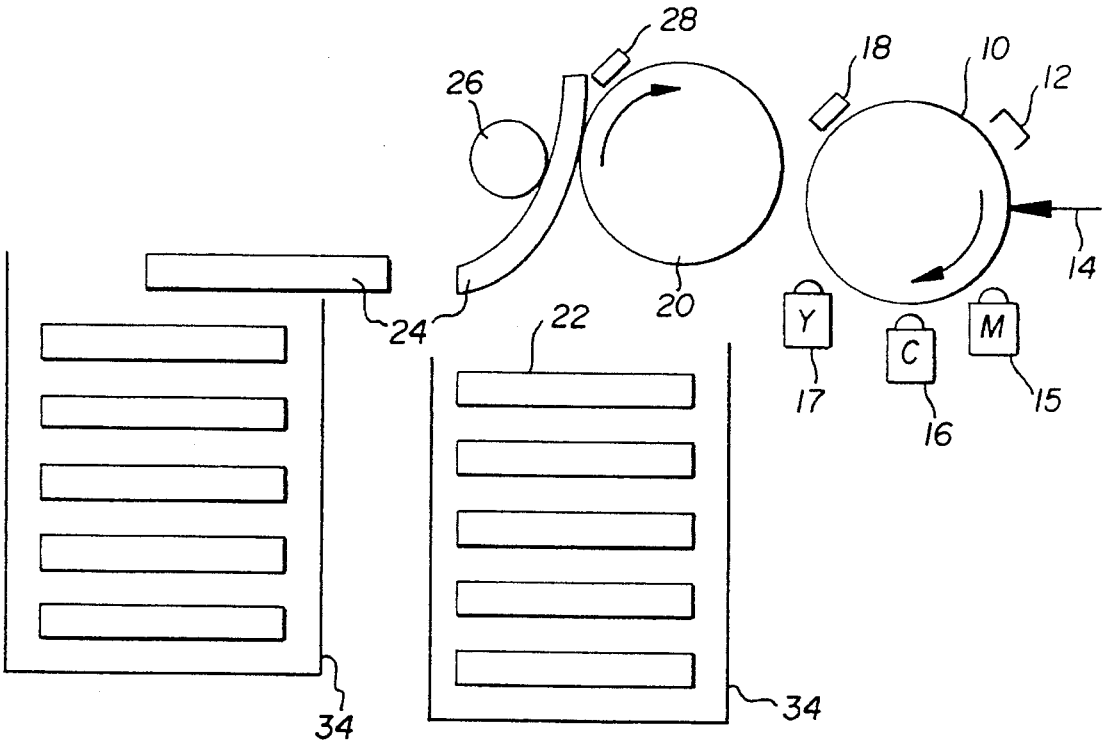

The selection of area modulation, density modulation, or hybrid exposure, up to this point, was assumed to be done by the operator. As the operator is aware of the effect that is desired in the finished print, the selection is made based on that. For example, if a high quality image is the ultimate goal, then thermoplastic-coated receiver would be selected and the exposure would be of a density modulation type. However, if it were the intent to duplicate, say, a proof for a magazine or newspaper, uncoated paper would be selected along with an area modulation exposure sequence. As an extension of this invention, mechanisms can be provided to automate the exposure selection process. In FIGS. 2 and 3, the detectors 18 and 28 monitor the amount of residual toner left on photoconductor drum 10 and transfer drum 20, respectively, after each transfer cycle. If the residual level exceeds certain levels, depending on the operating conditions and modes, recommendations are suggested for alternate exposure and/or transfer methods. This is explained in more detail in the flow chart shown in FIG. 7. Once the excessive amounts of residual toner is sensed, the LCU will display an informative message for the operator to select halftone or area modulation exposure. This could happen if the paper in use is rough and continuous tone exposure has been selected.

The selection of the exposure method and the paper type could be by the applications and properties shown in FIG. 1 under each combination. In the absence of specific desirable properties, the machine will revert to default settings. If both types of paper are available, i.e., thermoplastic coated and non-coated, the default exposure will be density modulation, the transfer method will be thermally assisted and the paper will be the thermoplastic-coated for producing the highest image quality. When non-coated paper is available only, the exposure will be area modulation and the electrostatic transfer method will be the default selection. This selection is based on lowest cost print production. The default settings are useful when the operator is not knowledgeable on imaging techniques. They are also important when the printer is used remotely and the user is not aware what kind of receiver is available in the printer.

This invention has been described in detail with particular reference to the preferred embodiment thereof, but it will be understood that variations and modifications can be effected within the spirit and scope of the invention.

We claim:

1. An electrostatic printing apparatus adapted to use first and second major groups of receiving materials, the first group being thermoplastic-coated receiver material and the second group being uncoated receiver material, said apparatus comprising:

means for selecting between thermoplastic-coated and uncoated receiver material;

means for using electrostatic transfer in response to the selection of uncoated receiver material;

means for using one of thermal assisted transfer and electrostatic transfer in response to the selection of thermoplastic-coated receiver material; and means for selecting from the following exposure techniques: area modulation exposure, density modulation exposure and a combination of both area and density modulation.

2. A printing apparatus as set forth in claim 1 wherein the selected thermoplastic-coated receiver material receives toner only by a thermally assisted transfer process.

3. A printing apparatus as set forth in claim 1 wherein, as a result of selecting an uncoated receiver material, toner is transferred to it by direct electrostatic transfer.

4. A printing apparatus as set forth in claim 1 wherein, as a result of selecting an uncoated receiver material, toner is transferred to it by indirect electrostatic transfer.

5. A printing apparatus using electrostatography to make prints, said printing apparatus comprising:

a first receiver path using a thermoplastic-coated receiver;

a second receiver path using an uncoated receiver;

means for selecting one of said paths; and an apparatus for exposing a photoconductor selectively using area modulation and density modulation.

6. A printing apparatus as set forth in claim 5 wherein the selectable exposure techniques include a combination of area and density modulation.

7. A method of generating electrostatographic prints on two types of receiver materials such as thermoplastic-coated and uncoated, said method comprising the steps of:

selecting thermoplastic-coated or uncoated receiver materials;

selecting electrostatic transfer in response to the selection of an uncoated receiver material;

selecting between thermal assisted transfer and electrostatic transfer in response to the selection of a thermoplastic-coated receiver material; and selecting between density modulation and area modulation exposure according to the type of receiver material selected.

8. The method as set forth in claim 7 wherein said electrostatic transfer is direct.

9. The method as set forth in claim 7 wherein said electrostatic transfer is indirect.

10. An electrostatic printing apparatus adapted to selectively use both thermoplastic-coated receiver materials and uncoated receiver materials; said apparatus comprising:

means for imagewise exposing a charged photoconductor to form a latent electrostatic image, said exposing means being operable to form the latent electrostatic image using exposure techniques selectable from area modulation exposure, density modulation exposure, and a combination of area modulation exposure and density modulation exposure;

means for developing the latent electrostatic image with toner particles to form a developed toner image on the photoconductor;

electrostatic transfer means for moving a developed toner image to a receiver material;

thermal assisted transfer means for moving a developed toner image to receiver material; and means for selecting between the electrostatic transfer means and the thermal assisted transfer means such that the electrostatic transfer means is selected for use with uncoated receiver materials and the thermal assisted transfer means is selected for use with thermoplastic-coated receiver materials.

11. An electrostatic printing apparatus as set forth in claim 10 wherein the selected thermoplastic-coated receiver material receives toner only by a thermally assisted transfer means.

12. An electrostatic printing apparatus as set forth in claim 10 wherein, as a result of selecting an uncoated receiver material, toner is transferred to it by direct electrostatic transfer means.

13. An electrostatic printing apparatus as set forth in claim 10 which, as a result of selecting an uncoated receiver material, toner is transferred to it by an indirect electrostatic transfer means.

* * * * *